US005244549A

United States Patent [19]

Bechtold

[11] Patent Number: 5,244,549

[45] Date of Patent: Sep. 14, 1993

[54] PROCESS FOR THE REDUCTION OF DYES

[75] Inventor: Thomas Bechtold, Dornbirn, Austria

[73] Assignee: Verein Zur Forderung der Forschung und Entwicklung in der Textilwirtschaft, Feldkirch, Austria

[21] Appl. No.: 613,670

[22] PCT Filed: May 31, 1990

[86] PCT No.: PCT/AT90/00052

§ 371 Date: Jan. 29, 1991

§ 102(e) Date: Jan. 29, 1991

[87] PCT Pub. No.: WO90/15182

PCT Pub. Date: Dec. 13, 1990

[30] Foreign Application Priority Data

Jun. 1, 1989 [AT] Austria ..... A1329/89

[51] Int. Cl.[5] ..... C25B 3/04

[52] U.S. Cl. ..... 204/134; 204/73 R; 204/74

[58] Field of Search ..... 2104/74, 73 R, 134

[56] References Cited

U.S. PATENT DOCUMENTS

| | | | |
|---|---|---|---|
| 2,147,635 | 2/1939 | Cole | 8/604 |
| 2,433,632 | 12/1947 | Soloman | 204/134 |
| 2,729,726 | 1/1957 | Rochester et al. | 204/134 |
| 3,518,038 | 6/1970 | Spatz et al. | 204/134 |
| 3,953,307 | 4/1976 | Supanekar et al. | 204/134 |
| 4,670,112 | 6/1987 | Lund | 204/74 |

FOREIGN PATENT DOCUMENTS

| | | |
|---|---|---|
| 0021432 | 1/1981 | European Pat. Off. . |
| 0060437 | 9/1982 | European Pat. Off. . |
| 534464 | 9/1931 | Fed. Rep. of Germany . |
| 2263138 | 6/1974 | Fed. Rep. of Germany . |
| 384866 | 2/1908 | France . |
| 1183585 | 10/1985 | U.S.S.R. . |

OTHER PUBLICATIONS

Bechtold et al., Textileveredlung, vol. 25, No. 6, pp. 221–226 (1990).

Zysman, Industrie Textile, No. 933, pp. 201 ∝ 207 (Mar., 1965).

*Primary Examiner*—John Niebling
*Assistant Examiner*—Brian M. Bolan
*Attorney, Agent, or Firm*—Wenderoth, Lind & Ponack

[57] ABSTRACT

In a process for reducing dyes in aqueous solution, a pair of electrodes is immersed in the solution. The cathode potential is maintained below the value at which hydrogen is evolved. A reducing agent is used, the redox potential of which, increased by the charge transfer overvoltage required for the reduction of the oxidized form of the reducing agent to the reduced form at the cathode, is less than the cathode potential.

6 Claims, 1 Drawing Sheet

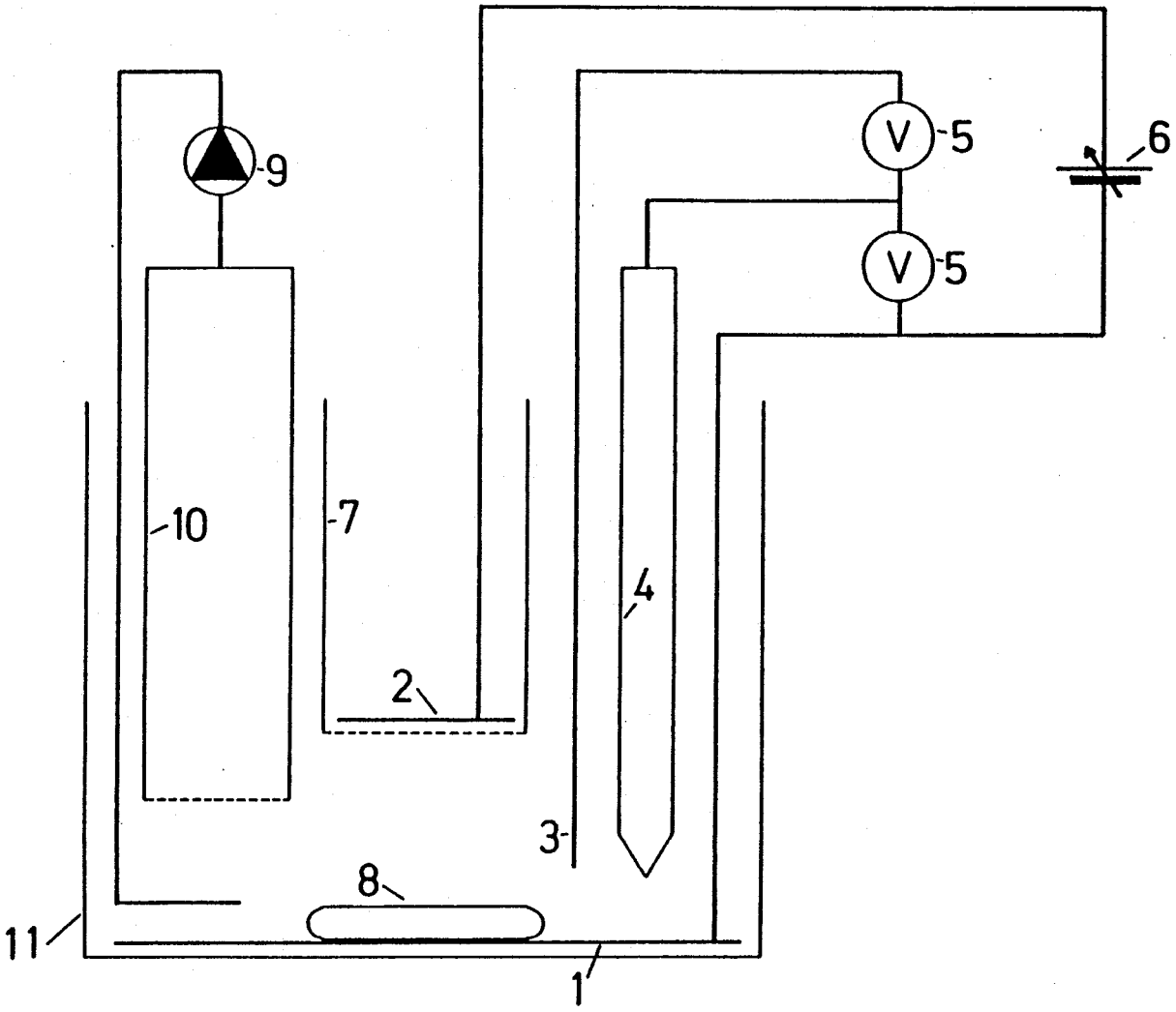
6
5
5
4
3
1
2
7
8
9
10
11

PROCESS FOR THE REDUCTION OF DYES

BRIEF DESCRIPTION OF THE INVENTION

The invention relates to a process for the reduction of dyes in an aqueous solution with a pH>9, using a reducing agent with a redox potential of over 400 mV which is present dissolved in a reduced and oxidized form, wherein a pair of electrodes, whose cathode potential is held below the value at which hydrogen is generated, is introduced into the solution.

BACKGROUND OF THE INVENTION

In textile finishing, vat dyes for dyeing cellulose fibers have a significant share of the marked (approx. 12.5%, world consumption approx. 25,000 tons per year). In particular, owing to the high fastness, this class of dyes belongs to the high-grade dyes. When used in dyeing, the insoluble dye particles that have primarily no fiber affinity are converted by reduction into their alkali-soluble leuco form. The reduced dye has a high affinity for the substrate and at this stage attaches rapidly to the product to be dyed. When the absorption phase has ended, the leuco form is oxidized in order to fix the dye, thus forming the water insoluble pigment. The dyes are, in their basic chemical structure, frequently anthraquinonoid or indigoid types. Sulfur dyes are inferior to vat dyes from a qualitative point of view, but price-wise are very good, so that they have a relatively large share of the market in cellulose dyeing (25%, 50,000 tons per year).

Sulfur dyes are used analogously to vat dyes, where the reduction of sulfur dyes is possible at lower redox potentials.

Many textile dyes of other classes of dyes contain azo groups in the dyeing portion of their molecule. These azo groups can be split irreversibly through reduction, a feature that can be exploited to disintegrate the dyes (stripping and correction of faulty dyeings).

Reducing agents are also added to destroy excess bleaching agents, for reductive bleaching (wool) and reductive waste water treatment (decolorization).

The main reducing agent for vat dyeing and for reductive splitting of azo dyes is $Na_2S_2O_4$ (sodium dithionite) ("hydro"), which exhibits a reduction potential of approx. −1000 mV in an alkaline medium. Derivatives of sulfinic acid (BASF Rongalit types) are added for reductions at higher temperatures (vapor processes, high temperature (HT) process) (reduction potential at 50° C. approx. −1000 mV). Derivatives of sulfinic acid can be activated by the addition of heavy metal compounds such as Ni cyano-complexes, Co complexes, etc.. The addition of anthraquinone compounds as accelerator for the added reducing agents has been proposed, but is not carried out very much in practice.

Other reducing agents are thiourea dioxide (−1000 mV), hydroxyacetone (−810 mV) and sodium hydridoborate (−1,100 mV). Indigo lies, with respect to the requisite reduction potential (approx. −600 mV), between the vat dyes and the sulfur dyes. Here, in addition to "hydro", hydroxyacetone/sodium hydroxide solution can also be added as the reducing agent. Historically, ferrous sulfate ($FeSO_4$)-lime-vats, zinc-lime-vats and fermentation vats were added.

For sulfur dyeing, other reducing agents can also be used on account of the lower requisite reduction potential. The main reducing agents are $Na_2S$ and NaHS (reduction potential approx. −500 mV). Mixtures of glucose/sodium hydroxide solution have also been added.

In various Indian studies (cf. E. H. Daruwalla in Textile Asia, September 1975, pages 165 ff) a process of the kind characterized above has been proposed in which the consumption of sodium dithionite is reduced by the application of a direct voltage. This reduction can be traced to the fact that the reducing agent at the cathode is converted into a form that exhibits increased reducing power. Due to the reaction with the dye, this substance decomposes into the same products as the sodium dithionite itself. These products cannot be regenerated at the applied voltage at the cathode. Thus, this voltage is any way at a height that can be used only at the mercury electrode that is used, but for electrode materials that can be used in practice would lead to the generation of harmful hydrogen.

The reducing agents added at that time have various drawbacks when they are applied. $Na_2S_2O_4$, is a relatively expensive chemical, which must be imported from many countries. In the dyeing procedures, a large excess of $Na_2S_2O_4$, based on the volume required in theory for reduction, must be added. In the dye bath the oxygen present in the liquor must first be removed since not until then can the dye reduction begin. During the dyeing process, $Na_2S_2O_4$ is consumed continuously by atmospheric oxygen from the environment. The volume required ranges from approx. 1.25 to 2.5 kg reducing agent per kg of dye.

The high volume required results in an accumulation of oxidation products of the reducing agent in the dye liquor. Reuse of the dye liquor is possible only in a minimum of cases. The quantity of reducing agent in the dye bath to the end of the dyeing process must suffice for total reduction. Therefore, the dye bath is drained with a relatively large quantity of reducing agent. Therefore, oxidation takes place in a new treatment bath, since otherwise the entire excess reducing agent that is still present must also be oxidized in the dye bath.

The reducing agent bath leads, in the waste water, to a significant consumption of oxygen, a state that leads to waste water problems. When sulfides are used as the reducing agent, the cost of procurement is relatively low; however, the waste water problem gains increasingly in importance, since here, in addition to the consumption of oxygen, significant toxicity and odor-related problems arise.

BRIEF DESCRIPTION OF THE DRAWING

The single figure of drawing schematically depicts a device to carry out the process of the invention.

DETAILED DESCRIPTION OF THE INVENTION

The invention is based on solving the problem of avoiding the aforementioned drawbacks of past reducing agents. This is achieved in that a reducing agent is used whose redox potential (half-wave potential), increased by the charge transfer overvoltage for the return, taking place at the cathode, of the oxidized form of the reducing agent into the reduced form, is below the cathode potential.

According to the invention, the dye is not directly reduced at the electrode, a state that has already been proposed but has not proven itself. Rather, a reducing agent is added that reduces the dye in the conventional manner. Thus, it is oxidized and arrives in this oxidized form at the cathode, where it is returned again into its original state. Redox systems of this kind are called mediators in electrochemistry. To use such mediators to reduce dyes was not self-evident for several reasons. To date mediators were in themselves seldom added to an aqueous solution, only in very exceptional cases in the alkaline area, and not at all above a Ph value of 9. The substances that have been added to date to reduce dyes are, on the one hand, not usable for the process of the invention, since their oxidation products can be converted into the basic state only at cathode voltages at which an unreasonable generation of hydrogen at the cathode would have long ago taken place.

Thus, the cathode reduces the reversible redox system, which upon reaching the reduction potential of the dye, is in turn in a position to reduce the dye. Shifts in shades, induced by over reduction, are avoided by adjusting the optimal redox potential in solution. The object of the reversible redox system primarily in the first place is to generate a continuous regeneratable reduction potential in the dye liquor, thus resulting in there being no need to add more reducing agent to the dye liquor. The portion of reducing agent consumed by atmospheric oxidation is continuously regenerated at the cathode. No successor products from the addition of the reducing agent is produced in the dye liquor. There is also no accumulation due to the usually necessary addition of reducing agent. Following the removal of the non-fixed dye (centrifugation, filtration,...) the dye bath can be reused, only the volume of liquor lost with the fabric having to be replaced. There is no consumption of chemicals in the conventional sense. The dye can even be reoxidized in the dye bath, a feature that, according to the literature, should lead to an improvement in the rubbing fastness of the dye (dubious). This method is not economically defendable with the currently used reducing agents, since at the end of the dyeing process large quantities of reducing agent remain in the dye liquor and draining the dye liquor is more cost effective. A closed reuse of the entire dye liquor without expensive preparation is also out of the question in that case due to the continuous accumulation of successor products of the reducing agent.

Therefore, the use of indirect electrochemical reduction lowers not only the cost of reduction chemicals but also enables for the first time the closed cycling of the dye liquors following the removal of the residual dye. Therefore, dyeing without waste water with the exception of the rinse water is thus possible. Even those dye liquors that are currently highly loaded with chemicals can be completely recycled.

Different redox systems can be used for indirect electrochemical reduction of dyes as follows: As organic compounds with which the redox systems can be realized especially such compounds with an anthraquinonoid basic structure were investigated. Experiments with anthraquinone mono and disulfonic acid, hydroxyanthraquinones and various substituted products enabled the reduction of sulfur dyes and vat dyes with suitable potentials. The required volume of the anthraquinonoid compound ranges from $0.5 \cdot 10^{-3}$ mol/l to $3 \cdot 10^{-3}$ mol/l, where concentrations ranging from about $1.5 \cdot 10^{-3}$ mol/l are good. In evaluating the mandatory quantity of redox catalyst the introduction of oxygen from the air must also be taken into consideration. The required quantity of catalyst can be reduced by using a closed apparatus.

Inorganic compounds, which can be used for the feeding according to the invention must be sought primarily among the metal complex salts. For example, the Fe(II/III)-triethanolamine-sodium hydroxide solution system is suitable as the reduction mediator. The obtainable potentials of up to −980 mV enable the reduction of all current vat dyes, indigoid dyes, sulfur dyes, azo dyes without the addition of other reducing substances.

It can be expected of the expert who knows the teaching of the invention to find other reducing agents that can be added as mediators under the specified process conditions. In so doing, it is important that the activity of these substances decreases at most negligibly during the utilization period so that a large number of reduction cycles are guaranteed. The conversion on the surface of the electrode is assumed to be fast. The catalysis of secondary reactions by the reducing agent is assumed to be excluded. For commercial application slight toxicity is also demanded.

The reducing action of the different redox systems is still characterized by its half-wave potential within the scope of this specification. In itself a specific ratio between the reduced and the oxidized form of the substance used occurs at every potential. However, for commercially applicable systems there must be a specific loadability; the achieved reduction potential may not break down immediately. In practice this means that one must work in the range in which reduced and oxidized species are present in about the same quantity. To determine this potential, one does not have to wait for the formation of a state of equilibrium; rather it is also possible to determine dynamically the peak potential of the Cv curves between which the half-wave potential lies.

Finally the invention is explained in detail with the aid of a device to carry out the process and by means of a few embodiments. The device to carry out the process is shown schematically in the single drawing.

The illustrated device comprises a vessel 11 at whose bottom there is a working cathode 1 made of copper. To accelerate the transporting off of the reduction products there is a magnetic stirrer 8 above working cathode 1. To measure the cathode potential with the voltmeter 5 a reference electrode 4 (Ag/AgCl) is provided. The potential is measured in solution by its own measuring electrode 3 that is made of copper or platinum and which is connected to the reference electrode. In this manner the increase in potential in the solution can be observed as a consequence of the reduction system that is building itself up.

It is important that the working anode 2 is shielded by a diaphragm 7 in order to avoid a reoxidation at the anode in known manner. A vessel 10, which is filled with textiles to be dyed and through which the solution is sucked by the liquor circulating pump 9, whereupon it flows back into the vessel 11, is introduced into the electrolytic space that is on the cathode side in view of diaphragm 7.

When using cathode material having a higher hydrogen overvoltage, a working potential of up to −1,200 mV can be realized at the cathode with a power supply unit 6, depending on the liquor content, without generating hydrogen.

In the experiments described below the temperature ranged from 40° to 50° C., but the total temperature range of 20° to 90° could have been used.

Example 1

Reduction of a vat dye-indanthrene blue GC

Processing conditions:

Exhaust process, liquor ratio 1:20

Weight of fabric: 6.6 g Bw (100%) liquor volume 130 ml

Intensity of color: 3% (197 mg dye)

Dye bath: 4 g/l NaOH, 2 g/l triethanolamine, 0.5 g/l $Fe_2(SO_4)_3$

The working cathode is made of copper (area 36 $cm^2$); the working anode is made of Pt (area 10 $cm^2$). The working potential of the copper cathode is −1,130 mV with respect to a AgCl reference electrode. The fabric is wetted with liquor at 40° C. Following the addition of the redox system and the switching on of the working current (approx. 35 mA), the potential in the solution rises within 20 minutes to −940 mV and is held there for 1 hour. The reduced dye on the fabric is oxidized by rinsing. The dyeing is finished by boiling soaping in accordance with the instructions of the dye manufacturers.

The intensity of the dye achieved through dyeing meets the approximate values of the dye manufacturers.

Example 2

Reduction of a sulfur dye-hydrosol light green 3B

Processing conditions:

Exhaust process: liquor ratio 1:20

Weight of fabric: 6.68 g Bw (100%) liquor volume 135 ml

Intensity of color: 5% (334 mg dye)

Dye bath 8 g/l $Na_2CO_3$, 4 g/l triethanolamine, 0.5 g/l $Fe_2(SO_4)_3$

The working cathode is made of copper (area 36 $cm^3$); the working anode is made of Pt (area 10 $cm^2$). The working potential of the copper cathode is −1,150 mV with respect to a AgCl reference electrode. The fabric is wetted with liquor at room temperature (RT). Following the addition of the redox system and the switching on of the working current (approx. 30 mA, the potential in the solution rises within 20 minutes to above 800 mV and is held there for 40 minutes. During this period the dyeing temperature is increased to approx. 60° C.; the working current increases up to 60 mA; the potential in the solution reaches −870 mV. The reduced dye on the fabric is oxidized by rinsing. The dyeing is finished by boiling soaping in accordance with the instructions of the dye manufacturers.

The intensity of the dye achieved through dyeing meets the approximate values of the dye manufacturers.

Example 3

Reduction of an azo dye - remazol brilliant red BB

Processing conditions:

Exhaust process: liquor ration 1:20

Weight of fabric: 5.76 g Bw (100%) liquor volume 115 ml

Intensity of color: initial dyeing 10 g dye/kg fabric (KKV dyed)

Dye bath: 8.8 g/l NaOH, 4 g/l triethanolamine, 0.5 g/l $Fe_2(SO_4)_3$

The working cathode is made of copper (area 36 $cm^2$); the working anode is made of Pt (area 10 $cm^2$). The working potential of the copper cathode is −1,150 mV with respect to a AgCl reference electrode. The fabric is wetted with liquor at RT. Following the addition of the redox system and the switching on of the working current (approx. 20 mA), the potential in the solution rises within 20 minutes to −450 mV. The potential rises from −800 to −900 mV and is held there for 1 hour. The temperature is increased up to 55° C. The azo dye on the fabric is almost completely destroyed, a feature that is normally achieved by a treatment with $NaOH/Na_2S_2O_4$.

Example 4

Reduction of a BASF indigoid dye-brilliant indigo 4B-D

Processing conditions:

Exhaust process: liquor ratio 1:20

Weight of fabric: 7.0 g Bw (100%) liquor volume 140 ml

Intensity of color: 4% (280 mg dye)

Dye bath: 1.4 g/l NaOH, 30 g/l $Na_2SO_4$, 4 g/l triethanolamine, 0.5 g/l $Fe_2SO_4 \cdot 7H_2O$ The working cathode is made of copper (area 36 $cm^2$); the working anode is made of Pt (area 10 $cm^2$). The working potential of the copper cathode is −1,150 mV with respect to a AgCl reference electrode. The fabric is wetted with liquor at RT. Following the addition of the redox system and the switching on of the working current (approx. 10–20 mA), the potential in the solution rises within 60 minutes to above −870 mV, especially after the addition of $Na_2SO_4$. During this period the dyeing temperature is increased to approx. 45° C. The reduced dye on the fabric is oxidized by rinsing. The dyeing is finished by boiling soaping in accordance with the instructions of the dye manufacturers.

The intensity of the dye achieved through dyeing meets the approximate values of the dye manufacturers.

Example 5

Reduction of a sulfur dye-hydron blue 3R

Processing conditions:

The reduction of the dye is detected colorimetrically and evaluated.

Dye bath: 4 g/l NaOH, 0.5 g/l anthraquinone-1.5-disulfonic acid, 10 mg/l hydron blue 3R The working cathode is made of copper (area 88 $cm^2$); the working anode is made of Pt (area 6 $cm^2$). The working potential of the copper cathode is −850 mV with respect to a AgCl reference electrode. Following the addition of the redox system and the switching on of the working current (approx. 10–20 mA), the reduction of the dye is observed colorimetrically. Already at room temperature, the anthraquinone system used in the first place is reduced to approx. 34% within 20 minutes (having obtained the half-wave potential); the sulfur dye that is added at this stage is immediately reduced quantitatively. When the working current is switched off, the reoxidation of the sulfur dye can be observed.

I claim:

1. A process for the reduction of dye in an aqueous solution having a pH greater than 9, comprising employing a reducing agent which is present dissolved in the solution in a reduced and oxidized form, wherein a pair of electrodes is introduced into the solution, the cathode potential of said electrode pair being held at a value at which essentially no hydrogen is generated but which is sufficiently negative to return essentially all of the reducing agent which is transformed into its oxidized form in the process of reducing the dye, into its reducing form.

2. A process, as claimed in claim 1, wherein a cathode made of Cu, Zn, Pb or stainless steel is used.

3. A process, as claimed in claim 1 or 2, wherein a cathode with basic anthraquinonoid structure is used.

4. A process, as claimed in claim 3, wherein $0.5\text{-}10^{-3}$ mol/l to $3\text{-}10^{-3}$ mol/l, preferably $1.5\text{-}10^{-3}$ mol/l of the anthraquinonoid compound is used.

5. A process, as claimed in claim 1 or 2, wherein a metal complex salt is used as the reducing agent.

6. A process, as claimed in claim 5, wherein a mixture of $0.5\text{-}10^{-3}$ mol/l to $5\text{-}10^{-3}$ mol/l iron (II) or iron (III)-salt with triethanolamine is used.

* * * * *